United States Patent [19]

Humphrey

[11] Patent Number: 4,856,405

[45] Date of Patent: Aug. 15, 1989

[54] MEANS AND METHOD FOR FLAVORED WOOD REEDS FOR WOODWIND INSTRUMENTS

[76] Inventor: Sean P. Humphrey, 1023 Winegardner Rd., Des Moines, Iowa 50317

[21] Appl. No.: 84,831

[22] Filed: Aug. 13, 1987

[51] Int. Cl.[4] ..... B05D 1/18; G10D 9/02

[52] U.S. Cl. ..... 84/383 A; 427/442

[58] Field of Search ..... 84/383 A, 383 R; 427/392, 442

[56] References Cited

U.S. PATENT DOCUMENTS 1,776,566 9/1930 Newton et al. ..... 84/383 A
2,230,933 2/1941 Caire et al. ..... 84/383 A
2,319,419 5/1943 Lucas ..... 84/383 A
3,340,759 9/1967 Petzke ..... 84/383 A

FOREIGN PATENT DOCUMENTS 1160838 8/1969 United Kingdom ..... 84/383 A

*Primary Examiner*—Michael Lusignan
*Attorney, Agent, or Firm*—Zarley, McKee, Thomte, Voorhees & Sease

[57] ABSTRACT

A means and method for flavored wood reeds for woodwind instruments wherein a natural cane woodwind reed contains a non-toxic absorbable edible flavoring to give a pleasant taste to the reed. A method of imparting the flavoring to the reed includes saturating the pores of the cane with the flavoring.

9 Claims, 1 Drawing Sheet

MEANS AND METHOD FOR FLAVORED WOOD REEDS FOR WOODWIND INSTRUMENTS

BACKGROUND OF THE INVENTION

This invention relates to a means and method for flavored reeds on woodwind instruments to provide a pleasant taste to the reeds when they are used.

Many reeds are made from species of large water-loving grasses, commonly known as cane. They are therefore many times referred to as woodwind or wood reeds. When used, the tips of the reeds must be moistened each time before they are satisfactory for playing purposes. Eventually, the reeds become waterlogged with saliva. This results in degradation of the cellular structure of the cane from the moisture or acids carried by the saliva and the ducts and interstices of the reed are plugged by salts and other residue left when the saliva on the reed dries. Another major problem with these reeds is that they leave an unpleasant taste in the mouth when used.

The prior art has attempted to address the problem of degradation of the reed through a number of adaptations. Included in these attempts is the Newton U.S. Pat. No. 1,776,566, which describes impregnating the reeds with a solution of cellulose in order to make the reed more durable. The Caire U.S. Pat. No. 2,230,933, attempts to avoid the problem of cane reeds altogether by providing for a reed made of synthetic plastic material, which, among other advantages, overcomes the bad taste associated with other types of plastic reeds. However, plastic reeds have been found to lack the tune and other sound qualities of wood reeds. Additionally, certain plastics themselves leave a bad taste in the musician's mouth.

A natural cane woodwind reed impregnated with cured plastisol, or with plastisol and a mineral oil containing a suitable water sealant, is disclosed in the Petzke U.S. Pat. No. 3,340,759, to seal the interstices and prevent moisture absorption. Along the same lines is British patent No. 1,160,838, relating to improvement of reeds for woodwind instruments by improving resistance to moisture absorption through impregnating the reed with a cured plastisol.

The prior art does not, however, address the specific problem of overcoming the bad taste associated with use of natural cane reeds. This invention overcomes this problem by providing for a reed which is flavored with a natural or artificial non-toxic, edible substance. It preferably provides for the pores of the natural cane reed to be saturated with a flavored oil. In this manner, when the instrument is used, the user experiences a pleasant taste.

A surprising and advantageous result occurring in saturating the reed with the oil, is that the reed tone quality is as brilliant or even better than the untreated reed. Round, mellow, and solid tones are reproduced.

Therefore, it is an object of this invention to provide a means and method for flavored wood reeds for woodwind instruments for natural cane woodwind reed which have a pleasant taste.

Yet another object of the invention is to provide for a means and method as above described wherein the flavored reeds produce good tonal qualities.

This and other objects, features and advantages of the present invention will become more apparent with reference to the accompanying specification and claims.

SUMMARY OF THE INVENTION

A means and method for flavored wood reeds for woodwind instruments includes impregnation of flavoring to conventional wood reeds to enhance their taste when in use, to make the reeds more palatable and enjoyable for the musician.

Many different types and methods of flavoring can be used to accomplish the objects of the invention. In a preferred embodiment, a flavored oil is saturated into the reed. Other methods such as coating the reed, painting flavoring on the reed, or otherwise imparting flavoring to the reed might be used.

DETAILED DESCRIPTION OF A PREFERRED EMBODIMENT OF THE INVENTION

Figure 1:
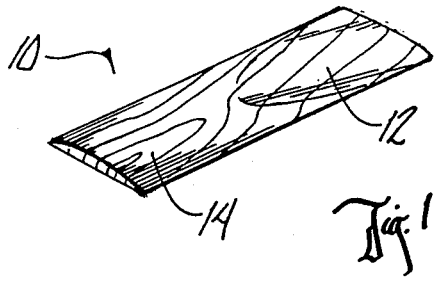
FIG. 1 is a perspective view of a wood reed for a woodwind instrument.

With reference to FIG. 1, there is shown a wood reed 10 for a woodwind instrument (not shown). Reed 10 has a front end 12 which coincides with the front of a mouthpiece of a woodwind instrument, and which is thinner in cross-section than the rear portion 14, which is utilized in the mounting of reed 10 to the instrument.

Flavoring is applied to a normally porous natural cane woodwind reed 10 by exposing it to a non-toxic edible flavoring which is capable of being absorbed by wood reeds. Vegetable and other edible oils are examples of the carriers effective in flavoring the cane or reed 10. With the preferred embodiment of the invention, oils known as LORANN OILS are applied to the wood. These are oils designed for flavoring substances and are distributed by Lorann Oils, Inc., 4518 Aurelius Road, Lansing, Mich. By way of example, cherry flavor may be imparted to the reed with the artificial cherry flavor LORANN OIL containing the following ingredients: Benzaldehyde and other aldehydes, Ansic alcohol and other alcohols, Gamma-Decalatone, Beta Ionone, Maltol, Ethyl acetate and other esters, cinnamon oil, clove oil, other essential oils, wild cherry bark, other natural extracts, water propylene glycol, and ethyl alcohol. Other flavors are available.

The reed is then saturated with the oil to impart the flavor to the reed. A preferred embodiment involves first drying the reed. Preferably, the reed is exposed to temperatures of 212° F. for 15–20 minutes. The oil is then applied, which can be accomplished through a number of methods. The oil may be brushed on and the alcohol allowed to evaporate.

Alternatively, the reeds may also be placed in a sealed container filled with the oil and placed into the sun. The flavor then saturates the wood. Saturation of the flavoring into the pores of the reed can be further enhanced by again heating the reed to 212° F. for approximately 15 minutes.

It will be appreciated that the present invention can take many forms and embodiments. The included preferred embodiment is given by way of example only, and not by way of limitation to the invention, which is solely described by the claims herein. Variations obvious to one skilled in the art will be included within the invention defined by the claims.

It is to be further understood that the present invention can be applied to any type of woodwind instrument, for example, clarinets, saxaphones, bassoons, oboes, pipe organs with wood reeds, and accordians with wood reeds.

What is claimed is:

1. A normally porous, natural cane woodwind reed having a non-toxic absorbable edible flavoring disposed within the pores of said reed, whereby a pleasant taste is imparted to said reed when used.

2. The reed of claim 1 wherein said flavoring is an oil.

3. The method of imparting a pleasant flavor to a normally porous natural cane woodwind reed, said method comprising substantially saturating the pores of said reed with a non-toxic absorbable edible flavoring, to make the reed pleasant for use and to deter and mask unpleasant tastes and smells caused by repeated use of the reed.

4. The method of claim 3 wherein said method comprises saturating said reed with an edible oil.

5. The method of claim 4 wherein said method comprises heating said reed and then placing said reed in contact with said flavoring.

6. The method of claim 5 wherein said method further comprises heating said reed to 212° F. for 15 minutes before applying said oil.

7. The method of claim 3 wherein said reed is placed in a bath of said flavoring.

8. The method of claim 3 wherein said flavoring is brushed on said reed.

9. The method of claim 6 wherein said method further comprises heating said reed to 212° F. for 15 minutes after said flavoring has been applied.

* * * * *